US010704773B2

(12) United States Patent
Huang

(10) Patent No.: US 10,704,773 B2
(45) Date of Patent: Jul. 7, 2020

(54) OUTDOOR LIGHT HOLDER STRUCTURE

(71) Applicant: Yuan Tsung Huang, Hsinchu (TW)

(72) Inventor: Yuan Tsung Huang, Hsinchu (TW)

( * ) Notice: Subject to any disclaimer, the term of this patent is extended or adjusted under 35 U.S.C. 154(b) by 0 days.

(21) Appl. No.: 16/172,745

(22) Filed: Oct. 27, 2018

(65) Prior Publication Data

US 2020/0132281 A1 Apr. 30, 2020

(51) Int. Cl.
*F21V 21/08* (2006.01)
*F21V 21/008* (2006.01)
*F21W 131/10* (2006.01)

(52) U.S. Cl.
CPC ..... *F21V 21/0816* (2013.01); *F21V 21/008* (2013.01); *F21W 2131/10* (2013.01)

(58) Field of Classification Search
CPC .. F21V 21/0816; F21V 21/008; F21V 19/001; F21V 19/0005; F21V 19/003; F21V 19/006; F21V 19/008; F21V 17/08; F21W 2131/10; F21W 2131/107; F21W 2131/109; F21W 2121/00; F21K 9/235; F21K 9/237
See application file for complete search history.

(56) References Cited

U.S. PATENT DOCUMENTS 5,439,389 A * 8/1995 Cheng ..... F21V 19/006 439/419
5,660,561 A * 8/1997 Tseng ..... F21V 19/006 439/340
5,853,299 A * 12/1998 Wu ..... H01R 4/2404 439/419
6,135,623 A * 10/2000 Lin ..... F21S 8/081 362/353
2003/0166357 A1* 9/2003 Tseng ..... H01R 4/2404 439/419

* cited by examiner

*Primary Examiner* — Bao Q Truong
(74) *Attorney, Agent, or Firm* — Guice Patents PLLC

(57) ABSTRACT

An outdoor light holder structure includes: a holder body, a partitioning plate being disposed in the holder body; an assembling member buckled with the holder body; a first electro-conductive plate received in a first through hole of the holder body, the first electro-conductive plate having a first tip section and a first stop section extending to the assembling member; a second electro-conductive plate received in a second through hole of the holder body, the second electro-conductive plate having a second tip section and a second stop section extending to the assembling member, the first stop section and the second stop section being slightly raised from the partitioning plate; and a conductive wire disposed between the holder body and the assembling member. The first and second stop sections are inlaid and engaged in the conductive wire to secure the conductive wire with holder body.

10 Claims, 7 Drawing Sheets

OUTDOOR LIGHT HOLDER STRUCTURE

BACKGROUND OF THE INVENTION

1. Field of the Invention

The present invention relates generally to a light holder structure, and more particularly to an outdoor light holder structure, which can be securely engaged with a conductive wire.

2. Description of the Related Art

Please refer to FIG. 1. A conventional outdoor light string 10 has multiple bulbs continuously serially connected with each other. In general, the light holder 11 of the bulb has two electro-conductive plates 12 with two sharp parts 121. The sharp parts 121 of the electro-conductive plates 12 are exposed to an outer side of the bottom section of the light holder 11. A conductive wire 13 is placed on the bottom section of the light holder 11 and then a cap body 14 is capped on the bottom section of the light holder 11, whereby the conductive wire 13 is restricted between the light holder 11 and the cap body 14. Under such circumstance, the sharp parts 121 of the electro-conductive plates 12 will thrust into the conductive wire 13 to form the light string 10, which can be quickly and continuously assembled.

In use, the light string 10 is hung on a tree or a building in any suitable position. At this time, the light holder 11 is often obstructed by an obstacle and pulled from the conductive wire 13. Only the sharp parts 121 of the electro-conductive plates 12 thrust into the conductive wire 13 so that when pulled, the electro-conductive plates 12 are easy to pull and deform and extracted out of the conductive wire 13. In this case, the electro-conductive plates 12 are electrically disconnected from the conductive wire 13. As a result, the light holder 11 will lose its function and the light string 10 cannot be powered on for use.

SUMMARY OF THE INVENTION

It is therefore a primary object of the present invention to provide an outdoor light holder structure, which has a reinforcement structure for more securely connecting the outdoor light holder with a conductive wire without easy detachment.

To achieve the above objects, the outdoor light holder structure of the present invention includes:

a holder body, a partitioning plate being disposed in the holder body to partition an interior of the holder body into a light chamber and a wire chamber, a first through hole being formed on the partitioning plate near a center thereof, a second through hole being formed on the partitioning plate near a sidewall of the holder body, two wire conduction holes being respectively formed through two lateral sides of the wire chamber;

an assembling member connected with the holder body from a top side thereof;

a first electro-conductive plate received in the first through hole, the first electro-conductive plate having a first electro-conductive section positioned in the light chamber, the first electro-conductive plate further having a first tip section and a first stop section extending into the wire chamber, the first tip section being disposed on one side of a rear end of the first stop section, the first stop section being slightly raised from the partitioning plate;

a second electro-conductive plate received in the second through hole, the second electro-conductive plate having a second electro-conductive section positioned on a sidewall of the light chamber, the second electro-conductive plate further having a second tip section and a second stop section extending into the wire chamber, the second tip section being disposed on one side of a rear end of the second stop section, the second tip section and the first tip section being positioned on different sides, the second stop section being slightly raised from the partitioning plate; and a conductive wire having an external insulation skin, the conductive wire being disposed in the wire conduction holes of the holder body, the assembling member serving to force the conductive wire toward the holder body, whereby the first stop section of the first electro-conductive plate and the second stop section of the second electro-conductive plate are oppositely inlaid in the insulation skin to form inlay indentations on the conductive wire.

In the above outdoor light holder structure, the first electro-conductive section and the first stop section of the first electro-conductive plate contain an angle, whereby the first electro-conductive section is transversely disposed on a bottom section of the light chamber. A first restriction block extends from a rear end of the first electro-conductive section. A restriction cavity is formed beside the first through hole on one face of the partitioning plate proximal to the wire chamber. The first stop section is restricted in the restriction cavity. The partitioning plate is further formed with a restriction rib disposed on one side of the first through hole opposite to the restriction cavity. The first restriction block leans on the restriction rib.

In the above outdoor light holder structure, the second electro-conductive section of the second electro-conductive plate is arched. At least one raised contact point is disposed on a surface of the second electro-conductive section. A second restriction block extends from a rear end of the second electro-conductive section. An insertion slot is formed on the sidewall of the light chamber. The second restriction block of the second electro-conductive plate is inlaid in the insertion slot.

According to the outdoor light holder structure of the present invention, when the conductive wire is placed into the wire chamber and the assembling member is buckled with the holder body, the conductive wire is forced by the assembling member to the holder body. At this time, the first tip section of the first electro-conductive plate and the second tip section of the second electro-conductive plate will respectively thrust into the conductive wire to electrically connect therewith. Also, the first stop section of the first electro-conductive plate and the second stop section of the second electro-conductive plate will be both inlaid and restricted in the insulation skin of the conductive wire by larger contact area to form the inlay indentations. Under such circumstance, the outdoor light holder can be more securely assembled with the conductive wire without easy detachment so that the reliability of the outdoor light holder is enhanced.

The present invention can be best understood through the following description and accompanying drawings, wherein:

DETAILED DESCRIPTION OF THE PREFERRED EMBODIMENTS

Figure 1:
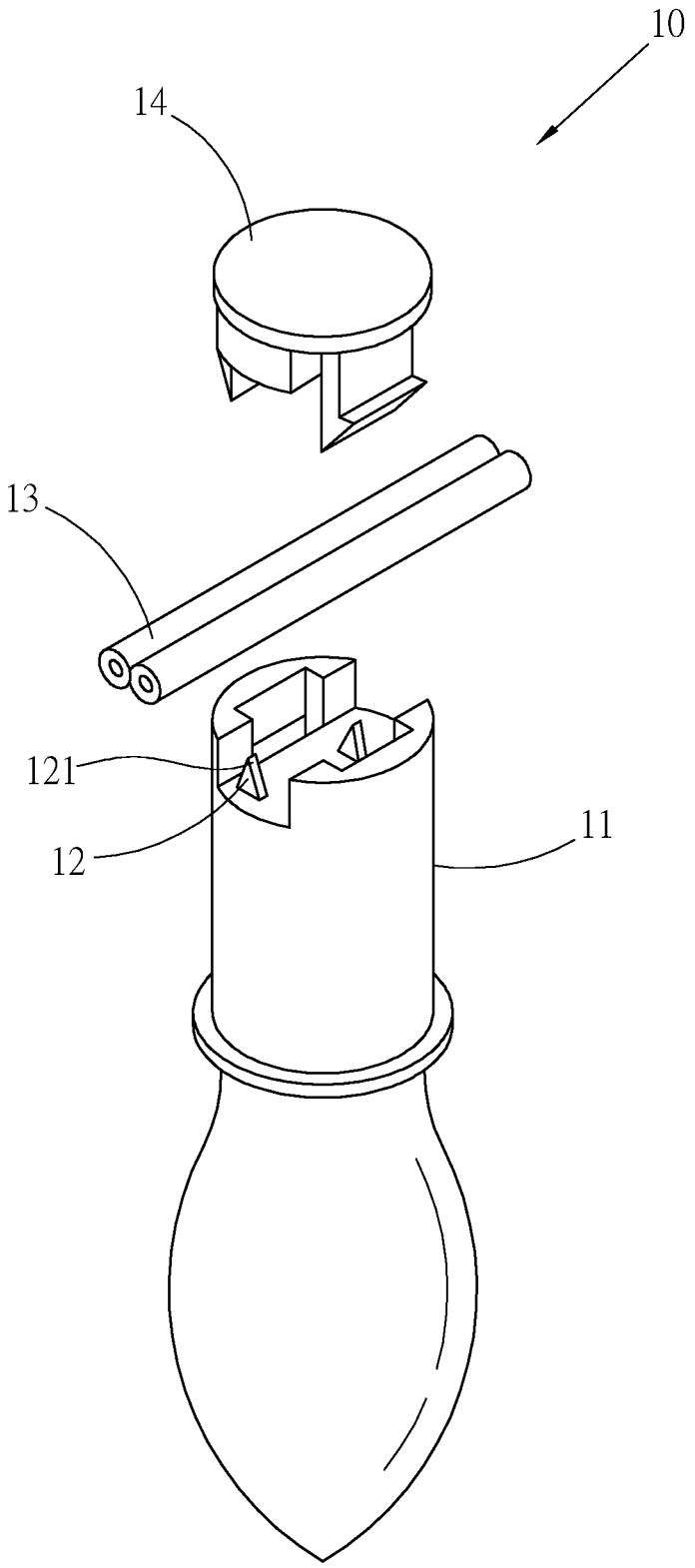
Fig. 1 PRIOR ART
FIG. 1 is a perspective view of a conventional light holder.
Figure 2:
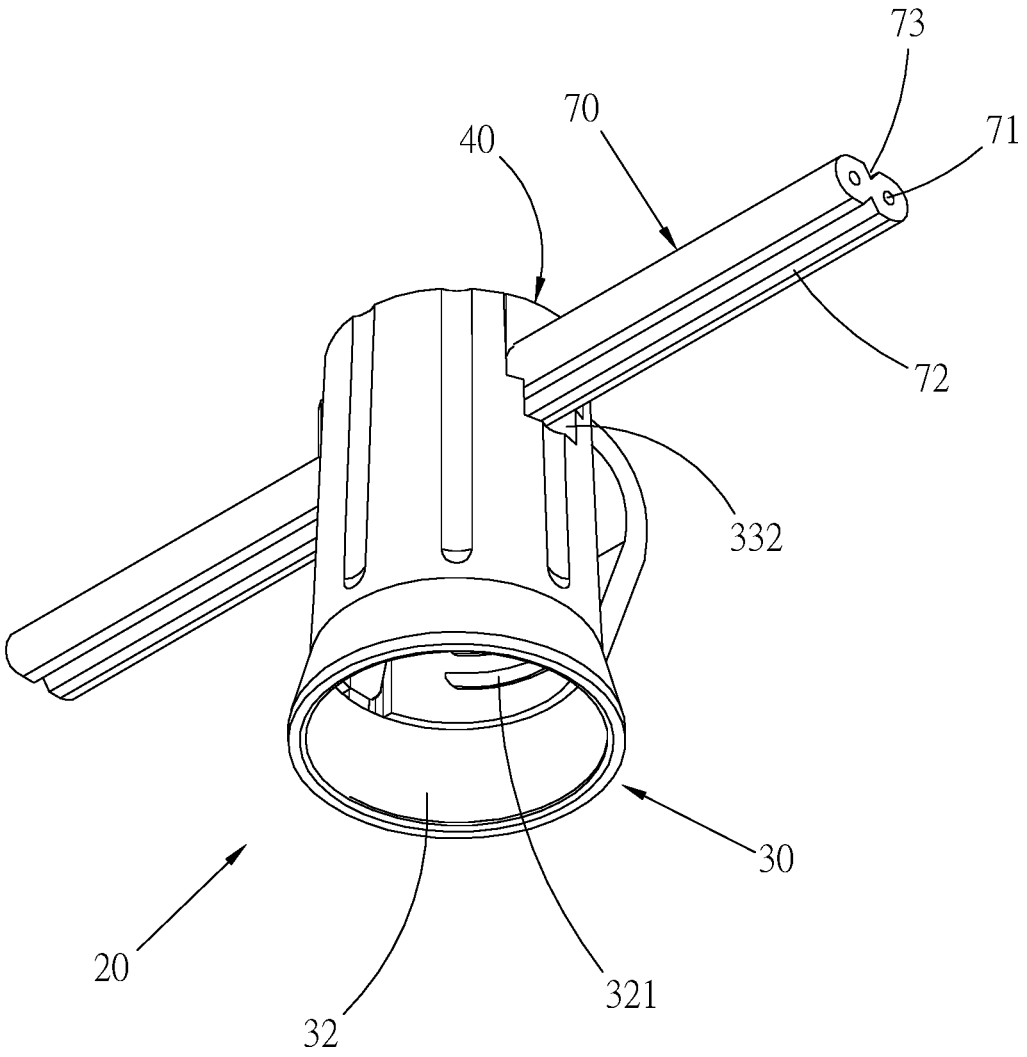
FIG. 2 is a perspective view of the outdoor light holder of the present invention.
Figure 3:
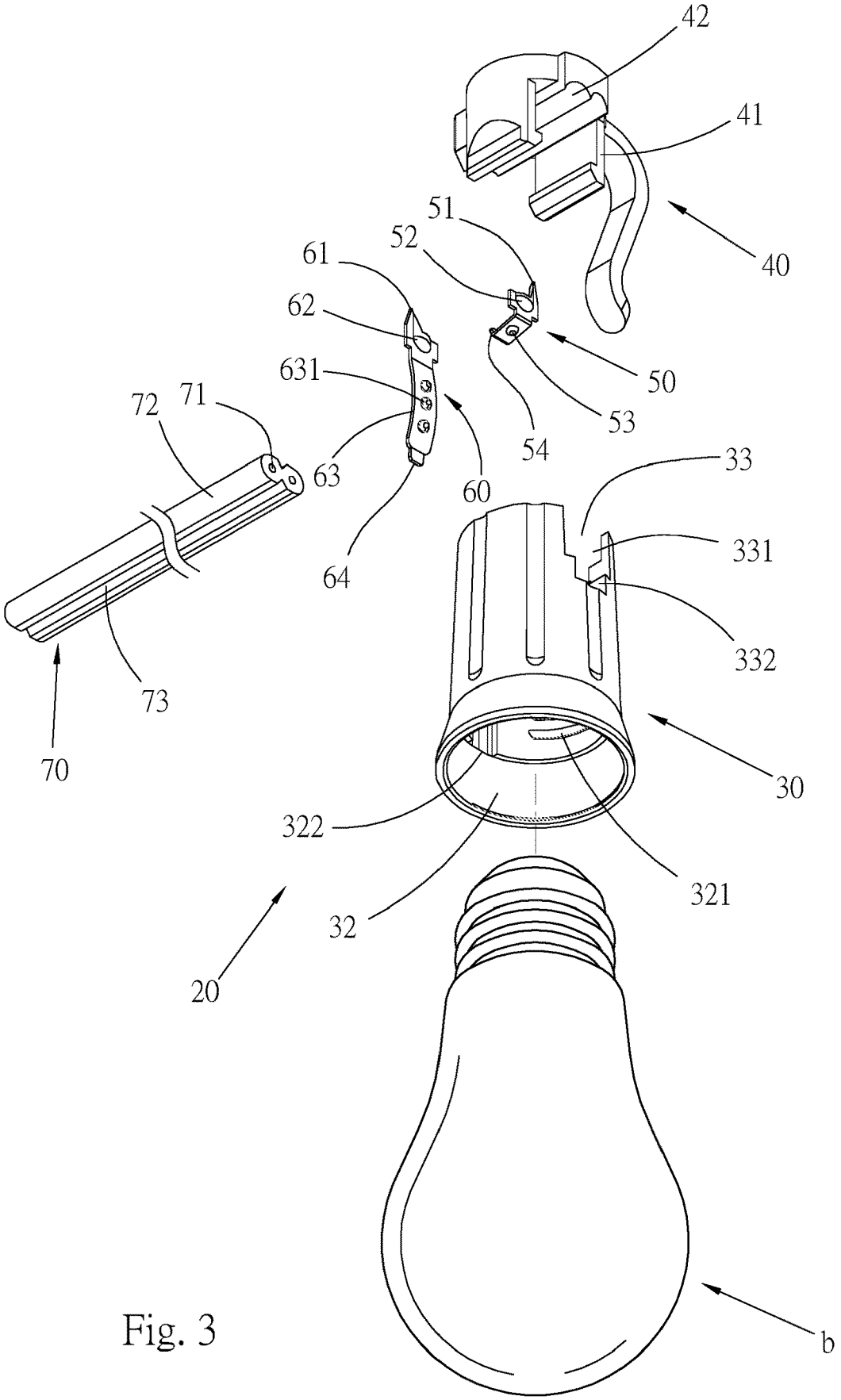
FIG. 3 is a perspective exploded view of the outdoor light holder of the present invention.
Figure 4:
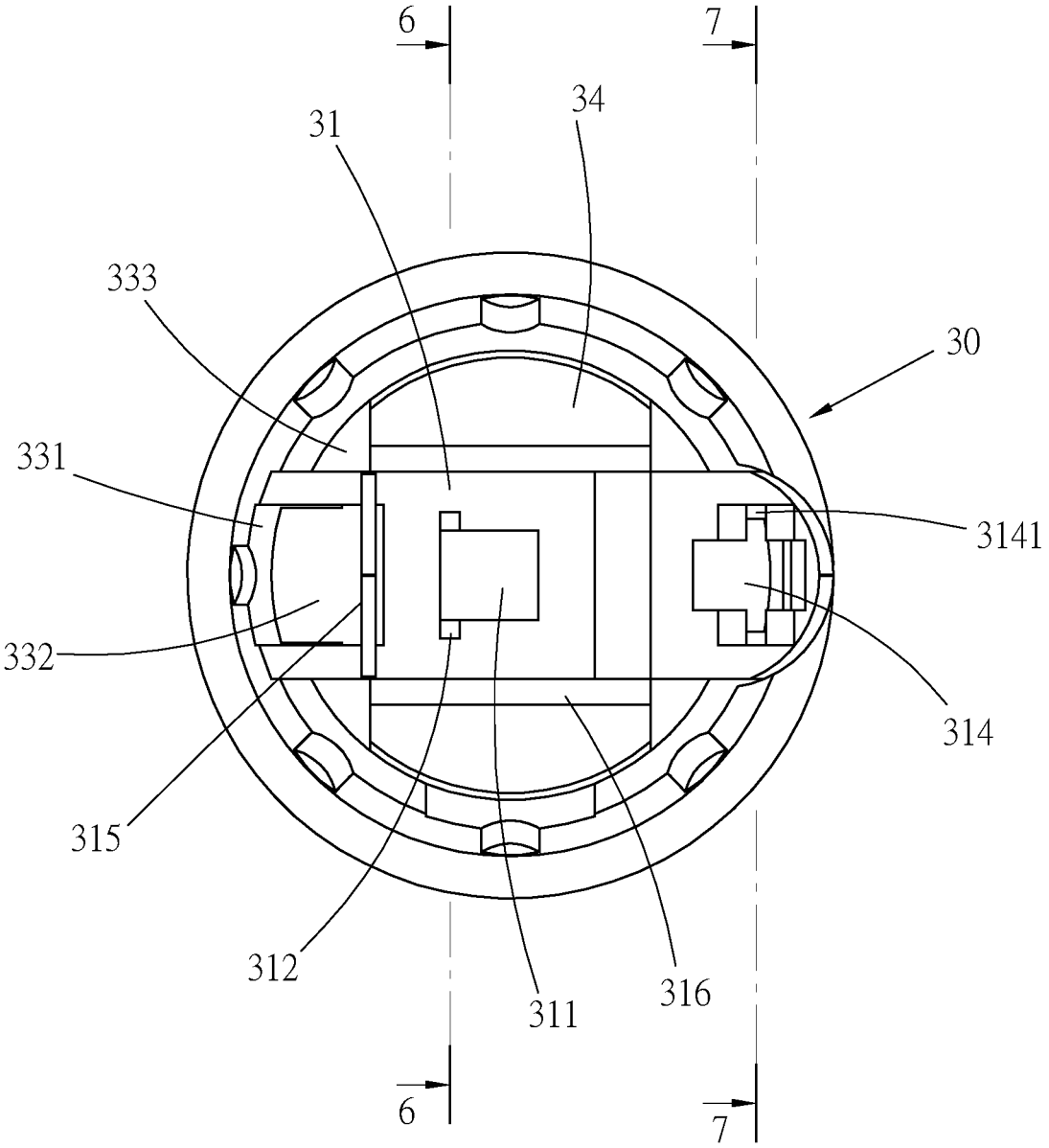
FIG. 4 is a top view of the holder body of the present invention, showing the wire chamber thereof.

Please refer to FIGS. 2 to 4. The outdoor light holder 20 of the present invention includes a holder body 30, an assembling member 40, a first electro-conductive plate 50 and a second electro-conductive plate 60. The outdoor light holder 20 can be assembled and connected with a conductive wire 70. By means of the first and second electro-conductive plates 50, 60, the outdoor light holder 20 can be electrically connected with the conductive wire 70. A rear end of the first electro-conductive plate 50 is formed with a first tip section 51 and a first stop section 52. A rear end of the second electro-conductive plate 60 is formed with a second tip section 61 and a second stop section 62. The first tip section 51 of the first electro-conductive plate 50 and the second tip section 61 of the second electro-conductive plate 60 can be thrust into the conductive wire 70 and electrically connected therewith. The first stop section 52 of the first electro-conductive plate 50 and the second stop section 62 of the second electro-conductive plate 60 will be inlaid and retained in the insulation skin 72 of the conductive wire 70 to form inlay indentations 74. The first and second stop sections 52, 62 serve to enhance the securing effect for the conductive wire 70 so that it is uneasy for the outdoor light holder 20 to detach from the conductive wire 70.

Figure 5:
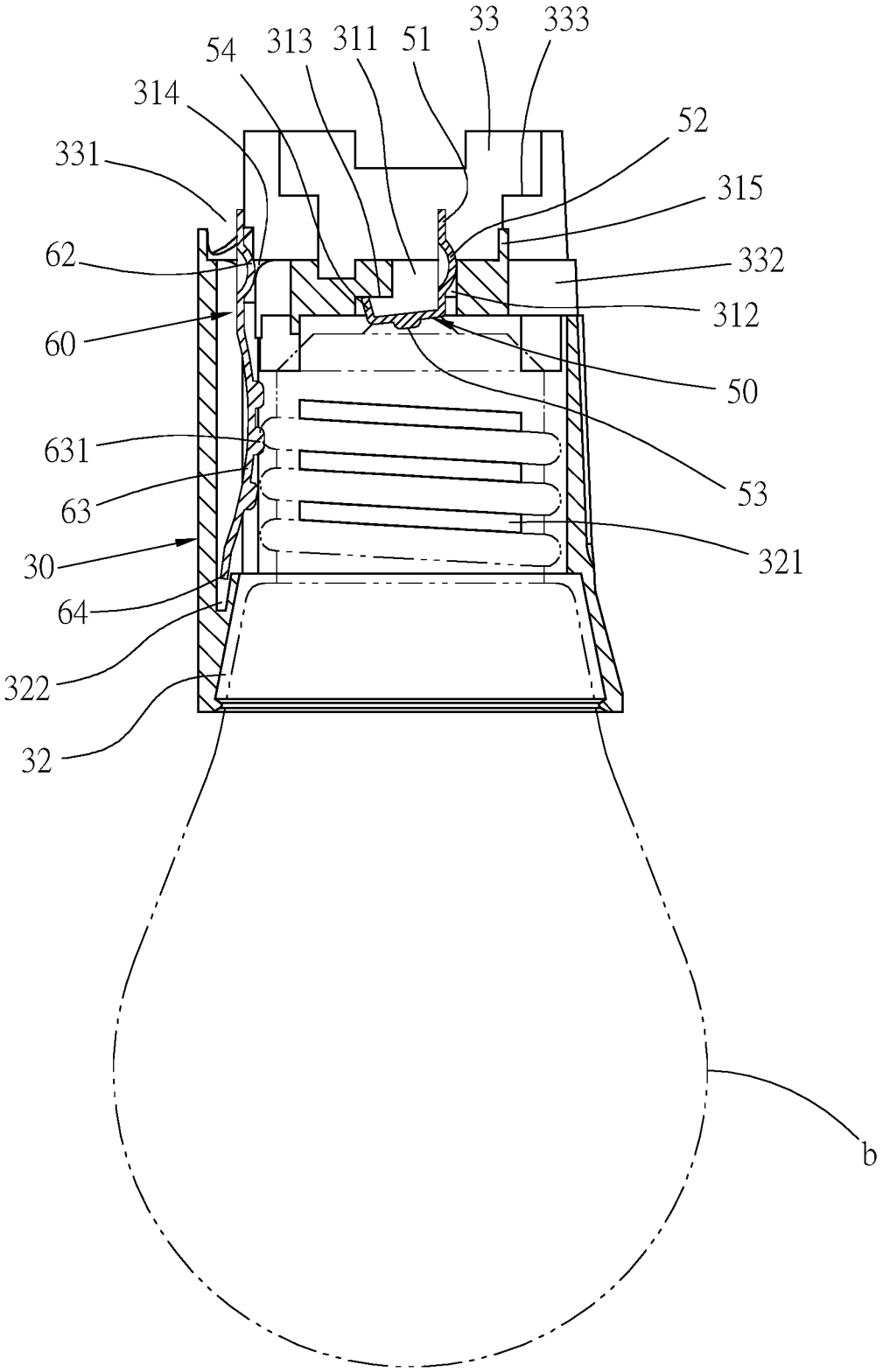
FIG. 5 is a sectional view showing the arrangement of the holder body and the first and second electro-conductive plates of the present invention.

Please refer to FIGS. 3 to 5. The holder body 30 of the outdoor light holder 20 of the present invention is partitioned by a partitioning plate 31 into a light chamber 32 and a wire chamber 33. The holder body 30 is further formed with two engagement perforations 34 on two sides of the partitioning plate 31. A first through hole 311 is formed through the partitioning plate 31 near a center thereof. A restriction cavity 312 is formed on one face of the partitioning plate 31 beside the first through hole 311, which face is proximal to the wire chamber 33. The restriction cavity 312 has a width larger than the width of the first through hole 311. The partitioning plate 31 is further formed with a restriction rib 313 disposed on one side of the first through hole 311 opposite to the restriction cavity 312. A second through hole 314 is further formed through the partitioning plate 31 near the sidewall of the holder body 20. Two engagement blocks 3141 are respectively formed at two ends of the second through hole 314. In addition, two restriction sharp protrusions 315 are disposed at the center of the partitioning plate 31. Two guide slopes 316 are formed on the face of the partitioning plate 31 in adjacency to the engagement perforations 34, which face is proximal to the wire chamber 33. The sidewall of the light chamber 32 is formed with two threaded sections 321. An insertion slot 322 is formed between the two threaded sections 321 in alignment with the second through hole 314. Two wire conduction holes 331 are respectively formed through two lateral sides of the wire chamber 33 in parallel to the partitioning plate 31. The wire chamber 33 is further formed with a water draining hole 332 at a rear end of one of the wire conduction holes 331. The water draining hole 332 passes through the partitioning plate 31 to communicate with the light chamber 32. The wire chamber 33 is further formed with guide blocks 333 on two sides of the engagement perforations 34.

The assembling member 40 is connected with the holder body 30 from a top side of the holder body. The assembling member 40 has two engagement buckles 41 respectively extending from two sides of the assembling member 40 toward the center thereof. The engagement buckles 41 are buckled in the engagement perforations 34 of the holder body 30. When buckling the assembling member 40, the engagement buckles 41 are placed into the wire chamber 33. The guide blocks 333 in the wire chamber 33 will restrict and guide the engagement buckles 41 to their setting positions. When the engagement buckles 41 contact the partitioning plate 31, the guide slopes 316 on the partitioning plate 31 help in outward stretching the engagement buckles 41. Then, after the engagement buckles 41 pass through the engagement perforations 34, the engagement buckles 41 will buckle with the partitioning plate 31 in a direction to the partitioning plate 31 so that the buckling force of the engagement buckles 41 is stronger, whereby the assembling member 40 is uneasy to detach from the holder body 30 after assembled. Two conductive wire passages 42 are formed on one face of the assembling member 40, which face has the engagement buckles 41. When the assembling member 40 is connected with the holder body 30, the conductive wire passages 42 and the wire conduction holes 331 define therebetween a receiving space for the conductive wire 70 to pass through. Also, the conductive wire passages 42 and the restriction sharp protrusions 315 will provide a locating effect for the conductive wire 70.

Please refer to FIGS. 3, 5, 6 and 8. The first electro-conductive plate 50 is received in the first through hole 311. The first electro-conductive plate 50 has a first electro-conductive section 53 positioned in the light chamber 32. The first tip section 51 and the first stop section 52 extend into the wire chamber 33. The first tip section 51 is disposed at the rear end of the first stop section 52 and the first stop section 52 is restricted in the restriction cavity 312, whereby the first stop section 52 is slightly raised from the partitioning plate 31. The first stop section 52 and the first electro-conductive section 53 contain an angle, whereby the first electro-conductive section 53 is transversely disposed in the light chamber 32. A first restriction block 54 extends from the rear end of the first electro-conductive section 53 to lean on the restriction rib 313.

Figure 7:
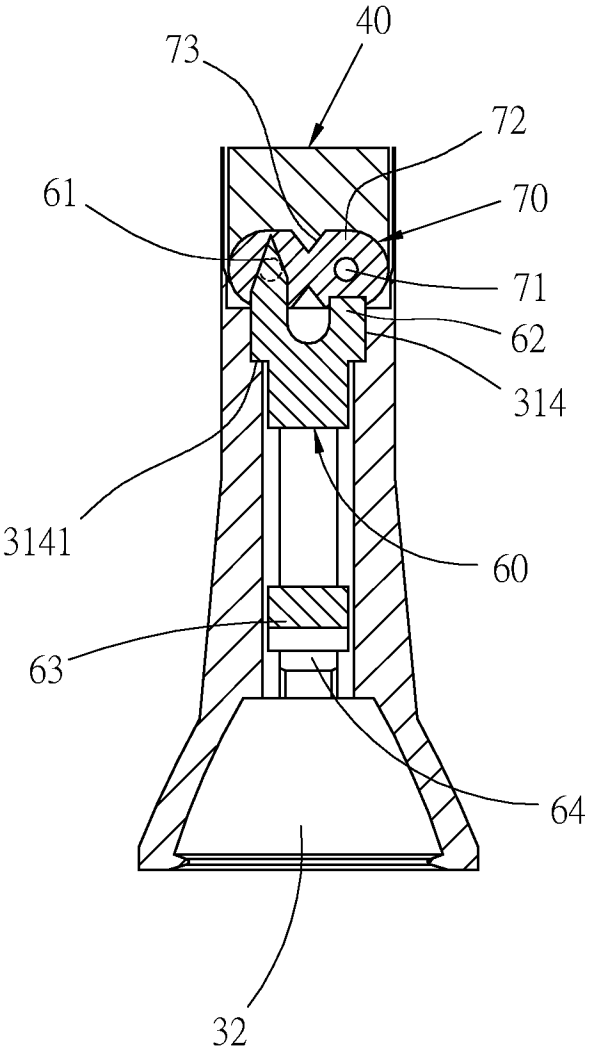
FIG. 7 is a sectional view showing that the second electro-conductive plate is inlaid and restricted in the conductive wire of the present invention.

Please refer to FIGS. 3, 5 and 7. The second electro-conductive plate 60 is received in the second through hole 314. The second electro-conductive plate 60 has a second electro-conductive section 63 positioned on the sidewall of the light chamber 32. The second tip section 61 and the second stop section 62 extend to the lateral side of the wire chamber 33. The second tip section 61 is disposed at the rear end of the second stop section 62. The second and first tip sections 61, 51 are positioned on two sides of the restriction sharp protrusions 315. The second stop section 62 is engaged on the engagement block 3141 and slightly raised from the partitioning plate 31. The second electro-conductive section 63 is arched and slightly raised from the sidewall of the light chamber 32. Three raised contact points 631 are disposed on the second electro-conductive section 63. A second restriction block 64 extends from the rear end of the second electro-conductive section 63 and is inlaid in the insertion slot 322.

The conductive wire 70 has two electrical wires 71 enclosed in an insulation skin 72. The insulation skin 72 is formed with a connection notch 73 between the two electrical wires 71. The conductive wire 70 is disposed in the wire conduction holes 331 of the wire chamber 33. The connection notch 73 is positioned on the restriction sharp protrusions 315, whereby the two electrical wires 71 are respectively positioned on two sides of the restriction sharp protrusions 315.

Figure 6:
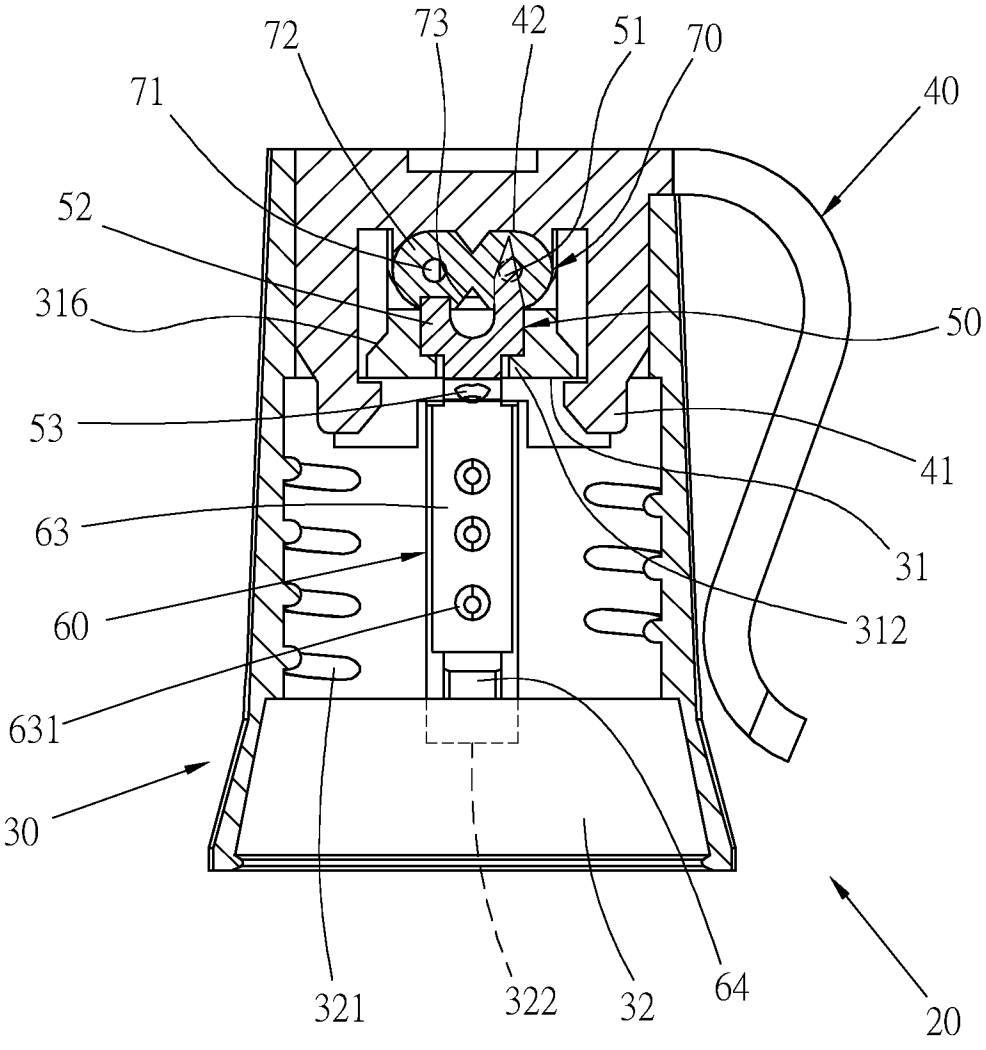
FIG. 6 is a sectional view showing that the first electro-conductive plate is inlaid and restricted in the conductive wire of the present invention.
Figure 8:
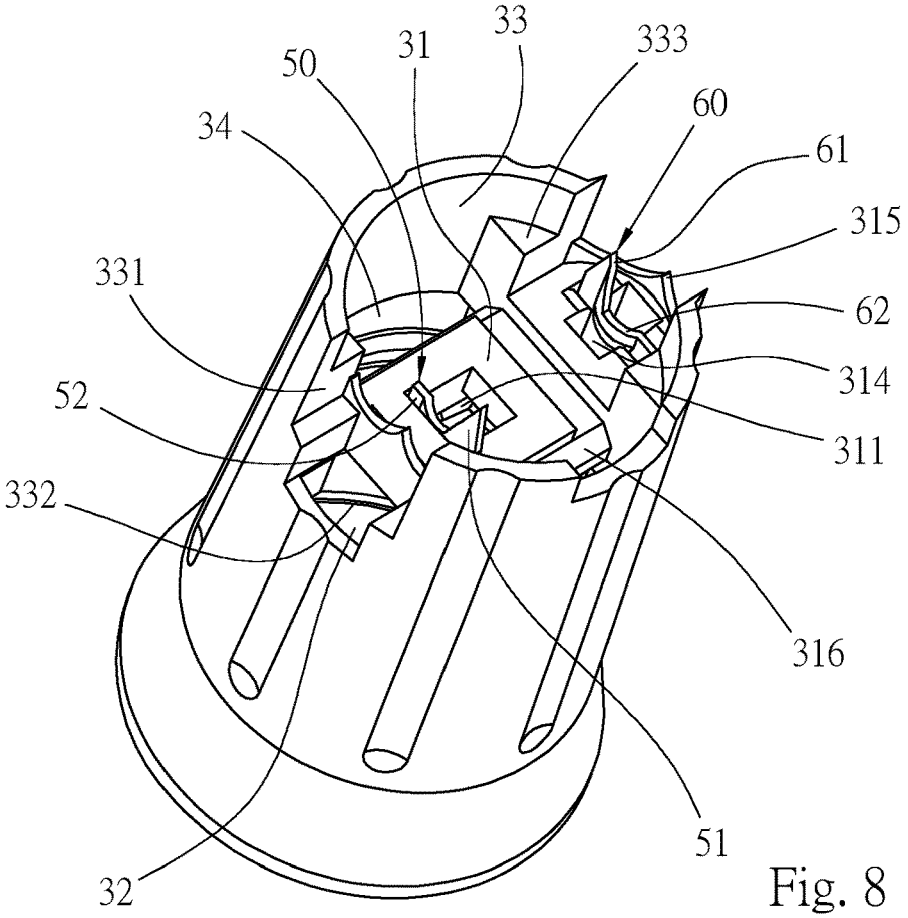
FIG. 8 is a perspective view of the holder body of the present invention, seen from the wire chamber.
Figure 9:
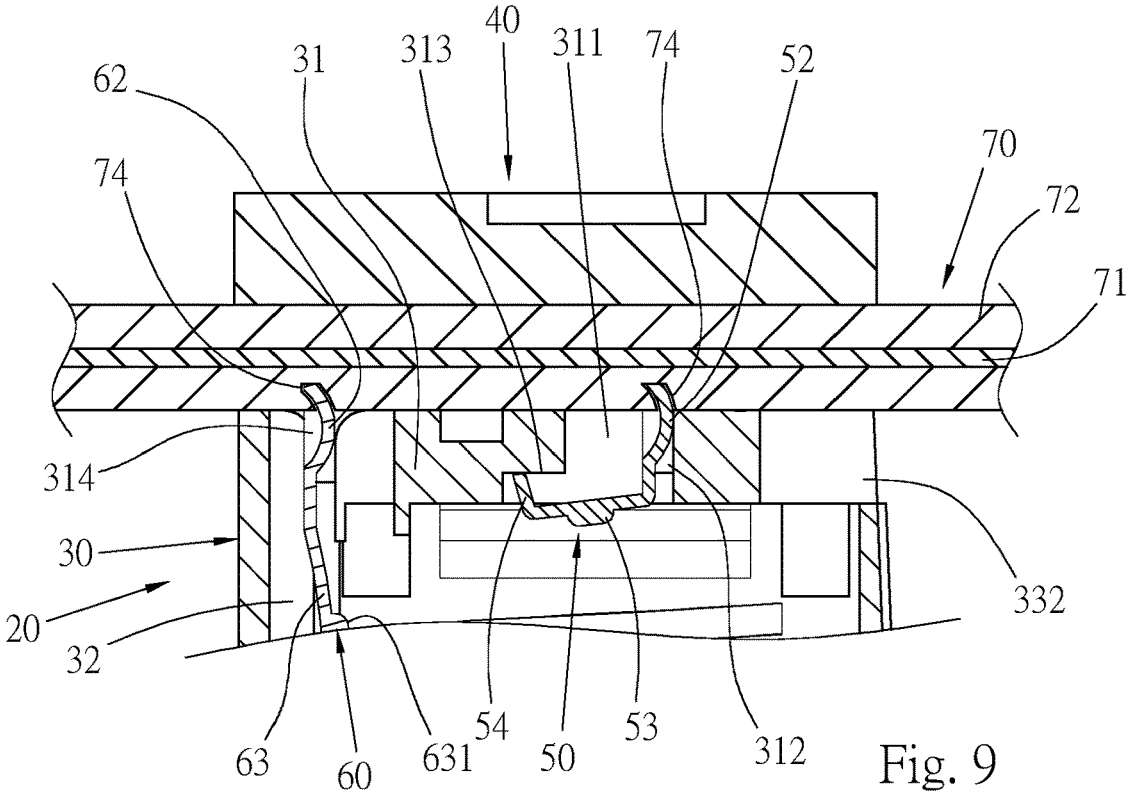
FIG. 9 is a sectional view showing that the first and second electro-conductive plates of the present invention are inlaid in and engaged with the conductive wire.

Please refer to FIGS. 3, 6 and 7. When assembled, after the conductive wire 70 is placed into the wire conduction holes 331, the assembling member 40 is pressed into the holder body 30 to make the engagement buckles 41 of the assembling member 40 buckled into the engagement perforations 34. The connection notch 73 of the conductive wire 70 is restricted by the restriction sharp protrusions 315, whereby the electrical wires 71 are respectively positioned in different conductive wire passages 42. At this time, the first tip section 51 of the first electro-conductive plate 50 and the second tip section 61 of the second electro-conductive plate 60 are respectively positioned on two sides of the restriction sharp protrusions 315. Therefore, the first and second tip sections 51, 61 will respectively thrust into different electrical wires 71 and electrically connect therewith. Also, referring to FIG. 9, the first stop section 52 of the first electro-conductive plate 50 and the second stop section 62 of the second electro-conductive plate 60 both extend out of the partitioning plate 31. Therefore, the first stop section 52 and the second stop section 62 will be both inlaid in the insulation skin 72 of the conductive wire 70, whereby the surface of the insulation skin 72 is pressed and deformed to form two inlay indentations 74. Under such circumstance, by means of the first stop section 52 and the second stop section 62, the two electro-conductive plates can be secured with the conductive wire 70 by larger area to enhance the connection relationship between the outdoor light holder 20 and the conductive wire 70. In this case, the outdoor light holder 20 and the conductive wire 70 can be more securely connected with each other to bear higher pulling force without easy detachment.

Please refer to FIGS. 3 and 5. When a bulb b is screwed into the light chamber 32, the bottom of the bulb b will electrically contact the first electro-conductive section 53, while a lateral side of the bulb b will electrically contact the second electro-conductive section 63. After the electrical wires 71 of the conductive wire 70 are powered on, the first and second electro-conductive plates 50, 60 and the bulb b together form a circuit to supply power for the bulb b. When the bulb b is pressed down, the first restriction block 54 will be pressed against the restriction rib 313, whereby the first electro-conductive section 53 can be secured in its position and prevented from disconnecting from the bulb b due to being pressed. The curvature of the second electro-conductive section 63 and the raised contact points 631 on the surface of the second electro-conductive section 63 serve to increase the contact area of the second electro-conductive section 63 with the bulb b.

In the outdoor light holder of the present invention, the first and second electro-conductive plates 50, 60 are securely disposed on the holder body 30. In addition, the first stop section 52 of the first electro-conductive plate 50 and the second stop section 62 of the second electro-conductive plate 60 are securely inlaid in the insulation skin 72 of the conductive wire 70, whereby the light holder 20 is uneasy to detach from the conductive wire 70 and the reliability in use of the light holder 20 is enhanced. Moreover, the engagement buckles 41 of the assembling member 40 inward extend to buckle on the partitioning plate 31 and provide a relatively stable securing effect, whereby the assembling member 40 is prevented from detaching from the holder body 30.

The above embodiments are only used to illustrate the present invention, not intended to limit the scope thereof. Many modifications of the above embodiments can be made without departing from the spirit of the present invention.

What is claimed is:

1. An outdoor light holder structure comprising:

a holder body, a partitioning plate being disposed in the holder body to partition an interior of the holder body into a light chamber and a wire chamber, a first through hole being formed on the partitioning plate near a center thereof, a second through hole being formed on the partitioning plate near a sidewall of the holder body, two wire conduction holes being respectively formed through two lateral sides of the wire chamber;

an assembling member connected with the holder body from a top side of the holder body;

a first electro-conductive plate received in the first through hole, the first electro-conductive plate having a first electro-conductive section positioned in the light chamber, the first electro-conductive plate further having a first tip section and a first stop section extending into the wire chamber, the first tip section being disposed on one side of a rear end of the first stop section, the first stop section being raised above the partitioning plate;

a second electro-conductive plate received in the second through hole, the second electro-conductive plate having a second electro-conductive section positioned on a sidewall of the light chamber, the second electro-conductive plate further having a second tip section and a second stop section extending into the wire chamber, the second tip section being disposed on one side of a rear end of the second stop section, the second tip section and the first tip section being positioned on different sides, the second stop section being raised above the partitioning plate; and a conductive wire having an external insulation skin, the conductive wire being disposed in the wire conduction holes of the holder body, the assembling member serving to force the conductive wire toward the holder body, wherein first stop section of the first electro-conductive plate and the second stop section of the second electro-conductive plate are oppositely inlaid in the insulation skin to form inlay indentations on the conductive wire.

2. The outdoor light holder structure as claimed in claim 1, wherein the first electro-conductive section and the first stop section of the first electro-conductive plate contain an angle, whereby the first electro-conductive section is transversely disposed on a bottom section of the light chamber, a first restriction block extending from a rear end of the first electro-conductive section, a restriction cavity being formed beside the first through hole on one face of the partitioning plate proximal to the wire chamber, the first stop section being restricted in the restriction cavity, the partitioning plate being further formed with a restriction rib disposed on one side of the first through hole opposite to the restriction cavity, the first restriction block leaning on the restriction rib.

3. The outdoor light holder structure as claimed in claim 1, wherein the second electro-conductive section of the second electro-conductive plate is arched, at least one raised contact point being disposed on a surface of the second electro-conductive section, a second restriction block extending from a rear end of the second electro-conductive section, an insertion slot being formed on the sidewall of the light chamber, the second restriction block of the second electro-conductive plate being inlaid in the insertion slot, an engagement block being disposed on an inner side of the second through hole, the second stop section being engaged on the engagement block.

4. The outdoor light holder structure as claimed in claim 1, wherein the assembling member has two engagement buckles extending toward the center of the assembling member, a guide slope being formed on one face of the partitioning plate in adjacency to the engagement perforation, which face is proximal to the wire chamber.

5. The outdoor light holder structure as claimed in claim 1, wherein two conductive wire passages are formed on a bottom face of the assembling member, on which a bottom face the engagement buckle is disposed.

6. The outdoor light holder structure as claimed in claim 1, wherein at least one restriction sharp protrusion is disposed on one face of the partitioning plate, which face is proximal to the wire chamber, the restriction sharp protrusion being positioned between the first tip section of the first electro-conductive plate and the second tip section of the second electro-conductive plate.

7. The outdoor light holder structure as claimed in claim 5, wherein at least one restriction sharp protrusion is disposed on one face of the partitioning plate, which face is proximal to the wire chamber, the restriction sharp protrusion being positioned between the first tip section of the first electro-conductive plate and the second tip section of the second electro-conductive plate.

8. The outdoor light holder structure as claimed in claim 1, wherein the wire chamber is further formed with guide blocks on two sides of engagement perforations.

9. The outdoor light holder structure as claimed in claim 1, wherein the wire chamber is further formed with a water draining hole at a rear end of wire conduction hole in communication with the light chamber.

10. The outdoor light holder structure as claimed in claim 1, wherein an engagement perforation being disposed on at least one side of the partitioning plate of the holder body; the assembling member having an engagement buckle disposed on at least one side of the assembling member, the engagement buckle being buckled in the engagement perforation from the wire chamber.

* * * * *